United States Patent [19]

Wessel-Berg et al.

[11] 4,445,071

[45] Apr. 24, 1984

[54] CIRCULAR BEAM DEFLECTION IN GYROCONS

[75] Inventors: Tore Wessel-Berg, Trondheim, Norway; Ivo Tammaru, Rancho Palos Verdes, Calif.

[73] Assignee: Hughes Aircraft Company, El Segundo, Calif.

[21] Appl. No.: 372,520

[22] Filed: Apr. 28, 1982

[51] Int. Cl.³ ..... H01J 25/00

[52] U.S. Cl. ..... 315/4; 315/3; 315/5; 315/5.24; 315/5.28

[58] Field of Search ..... 315/3, 4, 5, 5.26, 5.24, 315/5.27, 5.28

[56] References Cited

U.S. PATENT DOCUMENTS

| | | | |
|---|---|---|---|
| 2,638,539 | 5/1953 | Cuccia | 315/5.27 |
| 3,296,484 | 1/1967 | Feinstein | 315/5 |
| 3,346,819 | 10/1967 | Birdsall | 315/5 |
| 4,370,621 | 1/1983 | Sprangle et al. | 315/5 |
| 4,392,078 | 7/1983 | Noble et al. | 315/5 |
| 4,395,655 | 7/1983 | Wurthman | 315/4 |

*Primary Examiner*—Saxfield Chatmon, Jr.
*Attorney, Agent, or Firm*—P. M. Coble; A. W. Karambelas

[57] ABSTRACT

A gyrocon deflection system can provide circular beam deflection using a single RF coupler, without providing a phase difference between the two beam deflection signals to account for electron beam transit time between the two sets of deflection plates. The two sets of deflection plates are internally connected pairwise together so that both deflection regions are in RF phase, and the midplanes of the two sets are spaced 90° apart electrically at the desired operating voltage and frequency.

1 Claim, 2 Drawing Figures

CIRCULAR BEAM DEFLECTION IN GYROCONS

The Government of the United States of America has rights in this invention pursuant to Contract No. F30602-79-C-0089 awarded by the Department of the Air Force.

TECHNICAL FIELD

This invention relates to gyrocons and, more particularly, to a beam deflection system that can be operated with a single RF coupler instead of two phase-controlled couplers.

DESCRIPTION OF THE PRIOR ART

Gyrocons are known and comprises an electron gun, a deflection system, and an output cavity. The electron beam in gyrocons is circularly deflected, causing it to describe an expanding helix in the same manner as water projected from a nozzle that is rotated conically. The transverse deflection forces are provided by radio-frequency (RF) electromagnetic fields in a resonating cavity.

One known method of inducing circular beam deflection has been to use transverse magnetic fields in a cylindrical cavity. The required rotation of the field pattern is accomplished by exciting the cavity with two couplers which are circumferentially located 90° from each other, and are operated with an RF phase difference of 90°. Electric deflection fields could be utilized in a similar manner, although the cavity configuration would have to be more complex.

Another method for electrically deflecting the beam is analogous to beam deflection in cathode ray tubes. In a cathode ray tube, beam deflection is controlled by a transverse electric field set up by applying an electric potential between two parallel plates. Two sets of plates rotated 90° to one another are arranged around the beam and the plate sets are driven 90° out of phase, resulting in circular deflection of the beam. In a gyrocon, each set of parallel plates would be enclosed in a resonating cavity and excited by an RF coupler because of the typically high frequencies involved (a few hundred megahertz or greater).

Operation of such gyrocons is inherently complex because the finite transit time of the electrons between the two sets of deflection plates requires an appropriate phase difference to be provided between the deflection signals for the two sets of parallel deflection plates. It would be advantageous to have a system that did not involve such inherent complexities, and that required only one coupler.

SUMMARY OF THE INVENTION

It is a purpose of this invention to provide a relatively simple deflection system for a gyrocon to circularly deflect an electron beam.

It is a further purpose of this invention to provide circular beam deflection without providing for a phase difference between deflection signals to account for the electron beam's finite transit time between sets of deflection plates.

A gyrocon deflection system that simplifies the complexities inherent in prior art gyrocons has two sets of parallel deflection plates that are internally connected pairwise together, so that both deflection regions are in RF phase. The distance between the midplanes of the two sets of deflection plates is set so that the electron beam transit time for the desired operating voltage and frequency corresponds to an RF phase difference of 90°. Circular beam deflection can then be accomplished with a single RF coupler, instead of two phase-controlled couplers.

DETAILED DESCRIPTION OF THE INVENTION

Figure 1:
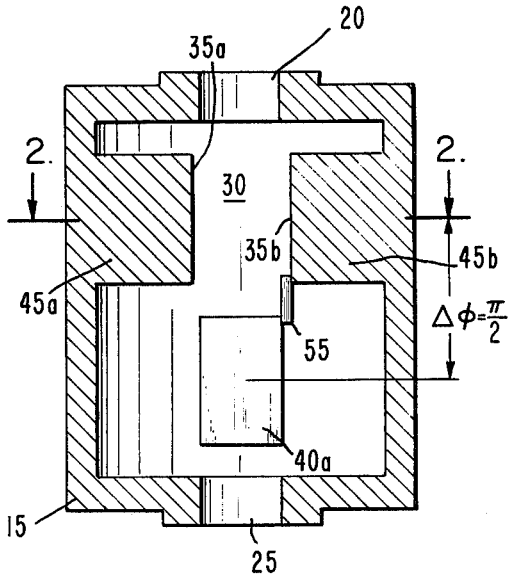
FIG. 1 shows a sectional side view of a double parallel plate deflection cavity in a gyrocon in accordance with the present invention.
Figure 2:
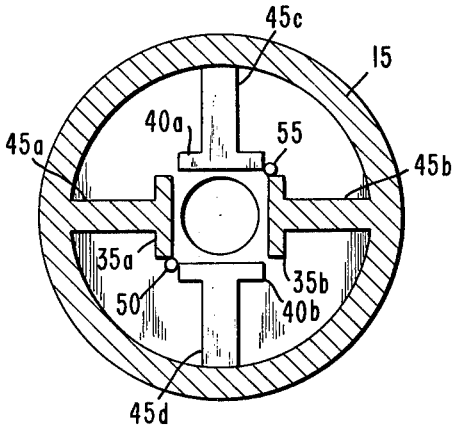
FIG. 2 shows a sectional end view of the deflection cavity of FIG. 1 taken along arrows 2—2.

The basic elements of a double parallel plate deflection cavity in a gyrocon according to the present invention are shown in FIGS. 1 and 2. The deflection cavity housing 15 is cylindrical and is partially closed at both ends. The openings 20 and 25 are disposed in the end walls of the housing 15, both openings being aligned with the axis of the cylindrical housing 15. The openings 20 and 25 define an empty deflection region 30 in the cavity housing 15. An electron beam may be directed into one opening 20, pass through the deflection cavity housing 15, and exit the other opening 25.

The two sets of two deflection plates are disposed about the deflection region 30 inside the deflection cavity housing 15. The first set of deflection plates (35*a* and 35*b*) are disposed opposite each other near the opening 20. The second set of deflection plates (40*a* and 40*b*) are disposed opposite each other near the opening 25. The second set of deflection plates 40 is disposed at right angles to the first set of deflection plates 35.

Each deflection plate 35*a*, 35*b*, 40*a*, 40*b* has a corresponding support element 45*a*, 45*b*, 45*c*, 45*d* associated with it that supports it and connects it to the deflection cavity housing 15. The deflection plates may be flat and disposed parallel to the other deflection plate in its set. When viewed end on, as in FIG. 2, the deflection plates 35, 40 seem to nearly define a square about the deflection region 30. The midpoints of the first and second sets of deflection plates, 35 and 40 respectively, are separated along the housing axis by a distance such that the electron transit time between midpoints corresponds to a phase difference of 90° at the frequency and operating voltage of the gyrocon.

The deflection plates are connected pairwise together by a pair of connecting conductors 50 and 55. The first connecting conductor 50 joins the deflection plates 35*a* and 40*b*, while the second connecting conductor 55 joins the deflection plates 35*b* and 40*a*. The first connecting conductor 50 has been omitted from FIG. 1 for clarity, since it connects deflection plate 35*a* to deflection plate 40*b*, which is not shown in the cross-section.

Although the deflection cavity of the preferred embodiment has been chosen to be cylindrical, it could be square, or of any other cross-sectional shape that has a 90° rotational symmetry.

What is claimed is:

1. A deflection arrangement for a gyrocon comprising:

a housing defining a deflection cavity and a pair of openings at the respective ends of said housing to enable an electron beam to pass through said cavity along the longitudinal axis thereof;

a first pair of deflection plates disposed parallel to one another on opposite sides of said axis at a first longitudinal location in said cavity;

a second pair of deflection plates disposed parallel to one another and perpendicular to said first pair of plates on opposite sides of said axis at a second longitudinal location in said cavity spaced from said first longitudinal location;

a first electrical conductor disposed within said cavity for directly electrically connecting one of said first pair of plates with one of said second pair of plates, a second electrical conductor disposed within said cavity for directly electrically connecting the other of said first pair of plates with the other of said second pair of plates; and the distance between the midplanes of said first and second pairs of plates corresponding electrically to 90° at a preselected operating voltage and frequency for said gyrocon.

* * * * *